United States Patent [19]

Walters, Jr.

[11] 4,049,240

[45] Sept. 20, 1977

[54] CONTINUOUS MIXER AND UNLOADER

[75] Inventor: Thomas Walters, Jr., Primos, Pa.

[73] Assignee: Ecolaire Incorporated, Philadelphia, Pa.

[21] Appl. No.: 696,464

[22] Filed: June 16, 1976

[51] Int. Cl.[2] ..... B01F 9/06

[52] U.S. Cl. ..... 259/3; 259/14; 259/30; 214/507

[58] Field of Search ..... 259/3, 14, 15, 16, 30, 259/31, 32, 33, 175, 176, 177 R; 214/507; 118/318, 320

[56] References Cited

U.S. PATENT DOCUMENTS

| | | | |
|---|---|---|---|
| 2,158,513 | 5/1939 | Lloyd | 259/3 |
| 2,420,217 | 5/1947 | Allen | 259/3 |
| 3,020,028 | 2/1962 | Bullock | 259/14 |
| 3,897,934 | 8/1975 | Phillips | 259/3 |

*Primary Examiner*—Robert W. Jenkins
*Attorney, Agent, or Firm*—Seidel, Gonda & Goldhammer

[57] ABSTRACT

A continuous mixer and unloader is disclosed for the purpose of moisturizing dry material during removal from a storage bin to avoid dust pollution which could occur during loading and transport. A screw conveyor feeds the material to a mixing drum circumscribing the conveyor. Stationary curved blades direct fine particles into a water shower spray located within said drum.

11 Claims, 3 Drawing Figures

CONTINUOUS MIXER AND UNLOADER

BACKGROUND

This invention is an improvement over the type B-31 continuous mixer and unloader sold commercially by the Allen-Sherman-Hoff Company of Wynnewood, Pennsylvania. Material such as fly ash may have a particle size of the order of one micron up to about 100 mesh. The purpose of the mixer and unloader is to moisten dry material such as fly ash during removal from a storage bin to eliminate dust pollution during loading and transport of the material. Due to the small size of fly ash particles, they are in a fluidized state and flow like a liquid.

In connection with handling of materials such as fly ash, there is a phenomenon known as incipient aeration. There is effectively no aeration provided for in the storage bin. When a particle starts to drop, it stirs up the air through which it drops, causing more particles to drop which in turn stir up more air thereby creating what is known as rat holing. Even if a large piece of material should fall off the side wall of the supply of material, it will flow through the rat hole rather than plug up the rat hole. There results an avalanche of uncontrollable flow in combination with fluidized particles which are not properly moistened by the above-mentioned mixer.

In the above-mentioned mixer, there is provided a doctor blade within the upper portion of the drum. Such doctor blades have heretofore been located and designed so the drier, lighter, or relatively unwetted mixture only would accumulate on it and drop back down into the continuously freshly mixed portion without exposing it directly to or through a water spray. This has resulted in varying performance because the properly wetted mixture continues on and out of the operation carrying dry portions with it.

This invention is directed to a continuous mixer and dust conditioner wherein a support is provided for a conveyor. A drum circumscribes the support and conveyor. The conveyor communicates with the drum interior.

A plurality of discrete stationary blades are provided in the drum adjacent to but spaced from the ID of the drum. A plurality of nozzles are supported within the drum adjacent to said blades. The blades are curved so as to direct material and any fluidized fines radially inwardly from the ID of the drum into the spray from said nozzles.

Because of the specific weight of the fluidized fine particles, the centrifugal action of the drum has little or no influence on such particles. The blades direct the fluidized particles into the spray from the nozzles thereby increasing the specific weight of the fluidized particles whereby they will then be subjected to centrifugal action and can be removed from the drum as part of a slurry.

It is an object of the present invention to provide a continuous mixer and dust conditioner which materially reduces or elimininates disadvantages of prior art devices subject to incipient aeration.

It is another object of the present invention to provide a continuous mixer and dust conditioner which includes a plurality of curved blades arranged to direct material into a nozzle spray to thereby increase the specific weight whereby it can be subject to centrifugal action.

It is another object of the present invention to provide a continuous mixer and dust conditioner which is more efficient than prior art devices in connection with fluidized material such as fly ash.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
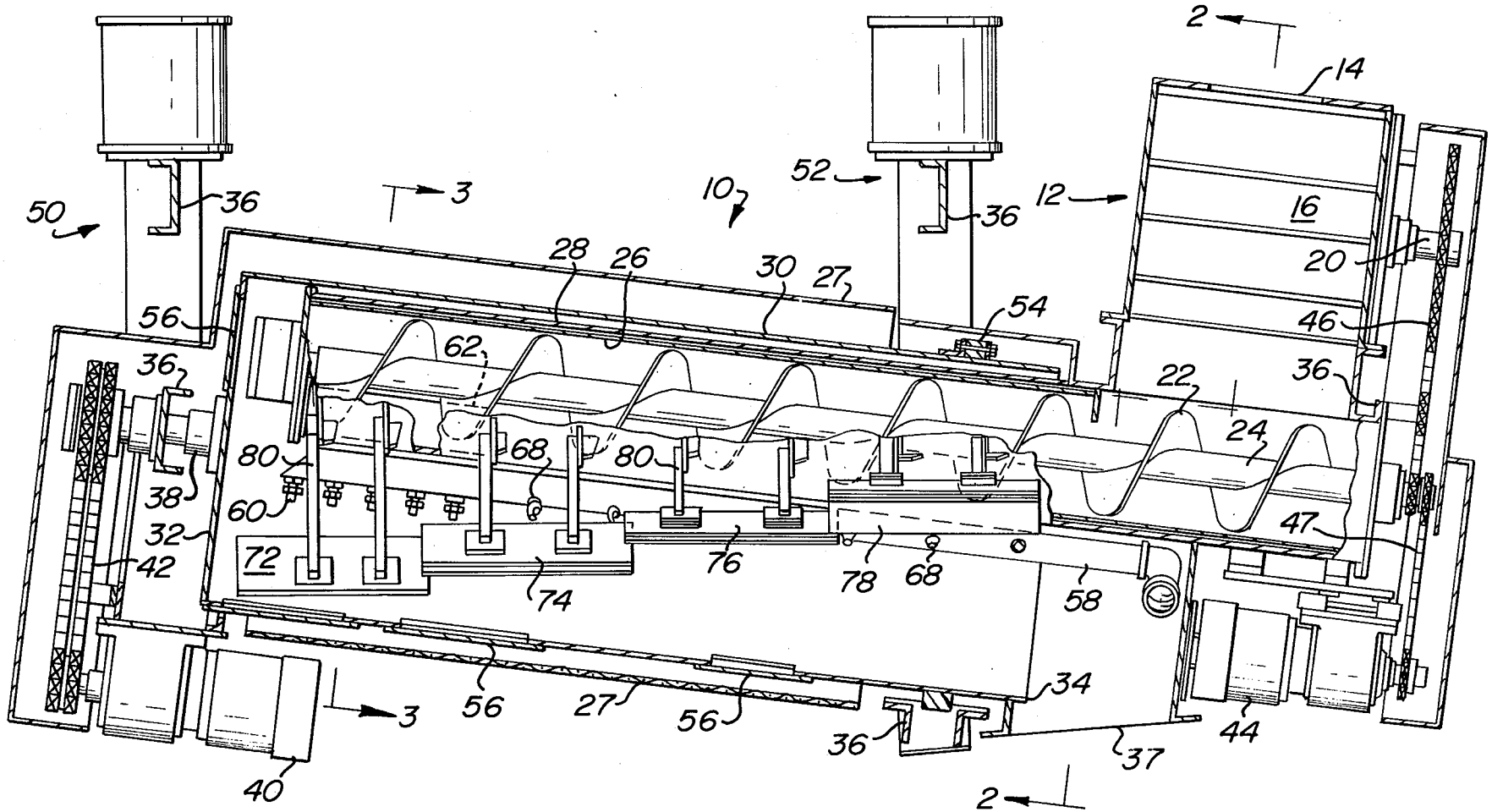
FIG. 1 is a longitudinal sectional view of apparatus in accordance with the present invention.

Referring to the drawing in detail, wherein like numerals indicate like elements, there is shown in the drawing apparatus in accordance with the present invention designated generally as 10. The apparatus 10 is a continuous mixer and unloader adapter to be supported below a storage bin to moisturize fine particles prior to loading of such particles for transport on a conveyor, railroad car, truck, etc. The purpose of the invention is to moisturize material so as to have between about 13 and 18% water by weight whereby such materials may be transported without creating dust pollution to the surrounding environment.

The apparatus 10 of the present invention includes a volumetric feeder 12 having an inlet port 14 adapted to communicate with a storage bin or the like. The feeder 12 includes a rotor 16 on shaft 20. The periphery of the blades of the rotor 16 cooperate with the shoe 18. Dry particulate material is fed by feeder 12 at a constant rate to a conveyor 22.

The conveyor 22 is preferably a screw conveyor having a shaft 24. The conveyor 22 is preferably inclined upwardly from right to left as shown in FIG. 1. A liner 26 surrounds the conveyor 22. The liner 26 is surrounded by a stationary support 28. The support 28 is preferably in the form of a cylindrical tube closed at its lefthand end in FIG. 1.

A drum 30 circumscribes the conveyor 22 and the stationary supporot 28. Drum 30 is closed at the lefthand end 32 and open at its righthand end 34. Drum 30 is adapted for rotation about its longitudinal axis which is inclined at approximately the same angle as the angle of inclination of the conveyor shaft 24. All of the above structure is supported by a frame designated generally as 36. A guard 27, part of which may be a screen, surrounds the drum 30. A discharge port 37 is provided adjacent to the end 34 of the drum 30. Discharge port 37 may be provided with a flow control valve if desired. Preferably, a flow control valve is provided between port 14 and the storage bin.

The frame 36 rotatably supports shaft 38 as shown at the lefthand end of FIG. 1. Shaft 38 is driven by motor 40 in any convenient manner such as by chains 42 and appropriate sprockets. Shaft 38 is connected to the closed end 32 of drum 30 whereby motor 40 drives drum 30.

Referring to the righthand end of FIG. 1, the frame 36 supports a second motor 44. The output of motor 44 is connected to shaft 24 in any convenient manner such as by chain 47 and appropriate sprockets. Another sprocket on shaft 24 is connected to shaft 20 by way of chain 46. The sprockets are preferably chosen in a manner so as to provide an overspeed drive of about10% for the screw conveyor 22 as compared with the rotor 16. In this manner, the conveyor 22 will remove material faster than it can be fed by the feeder 12.

The frame 36 includes brackets 50, 52 so that it can be supported from above. The frame 36 has a plurality of rotatable bearings, not shown, which contact the track 54 on the outer periphery of the drum 30 adjacent the open end 34 thereof. Such bearings rotatably support the righthand end of the drum 30 in FIG. 1. Bearings associated with shaft 38 rotatably support the lefthand end of the drum 30 in FIG. 1. Suitable bearings are provided on the closed end of the support 28 for rotatably supporting the lefthand end of the shaft 24 in FIG. 1.

The drum 30 may be provided with access doors 56 along its axial length. If desired, the closed end 32 of drum 30 may be provided with a similar access door 56 in line with the cylindrical support 28 in one rotative position of the drum 30 as illustrated in FIG. 1.

A water conduit 58 is provided for introducing water into the drum 30. Conduit 58 is provided with two discrete sets of nozzles. The first set of nozzles are designated 60 and are located adjacent the terminal end of the conduit 58 immediately adjacent opening 62. See FIG. 3. Opening 62 is an elongated opening in support 28 and liner 26 at about the 7 o'clock position in FIG. 3. The opening 62 is designated in phantom lines in FIG. 1.

Figure 3:
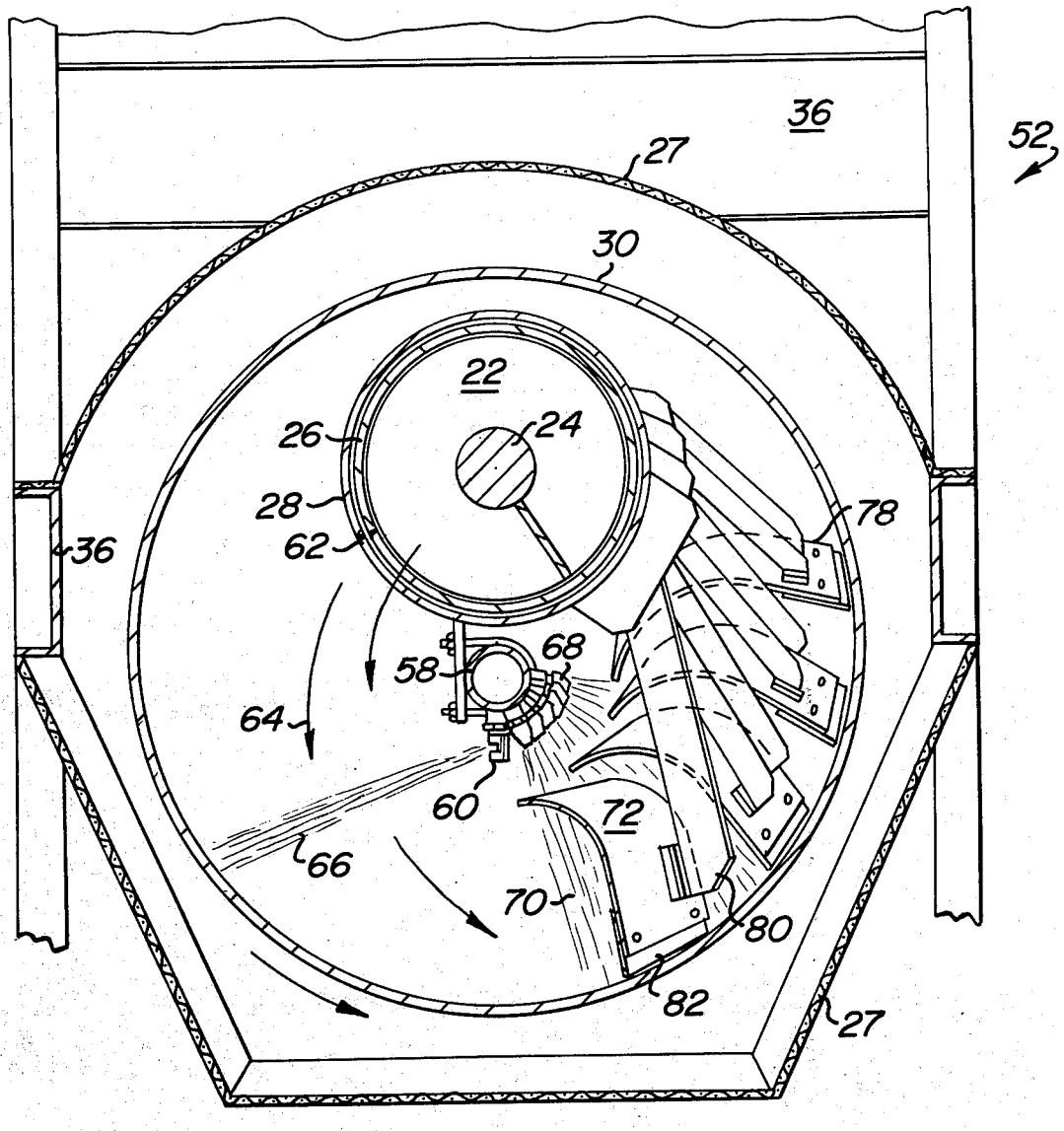
FIG. 3 is a sectional view taken along the line 3—3 in FIG. 1.

As shown in FIG. 3, the nozzle 60 discharges water, preferably with a turkey tail spray 66 in a direction whereby the spray 66 is below the opening 62. Hence, material discharged through opening 62 in a direction of arrow 64 must pass through the spray 66.

The second set of nozzles 68 direct water with a fan spray 70 to the opposite side of a vertical plane containing the axis of drum 30 from the spray 66. The nozzles 68 are preferably circumferentially arranged in a helical pattern on the conduit 58 and are located at spaced points therealong. As will be apparent from FIG. 1, the nozzle 68 occupies substantially the greatest portion of the length of the conduit 58 to a location adjacent the open end 34 of the drum 30. The nozzles 60 begin approximately at the location of the last of the nozzles 68. If the opening 62 is elongated even further, there may be an overlap of the positions of nozzles 60 and 68.

Figure 2:
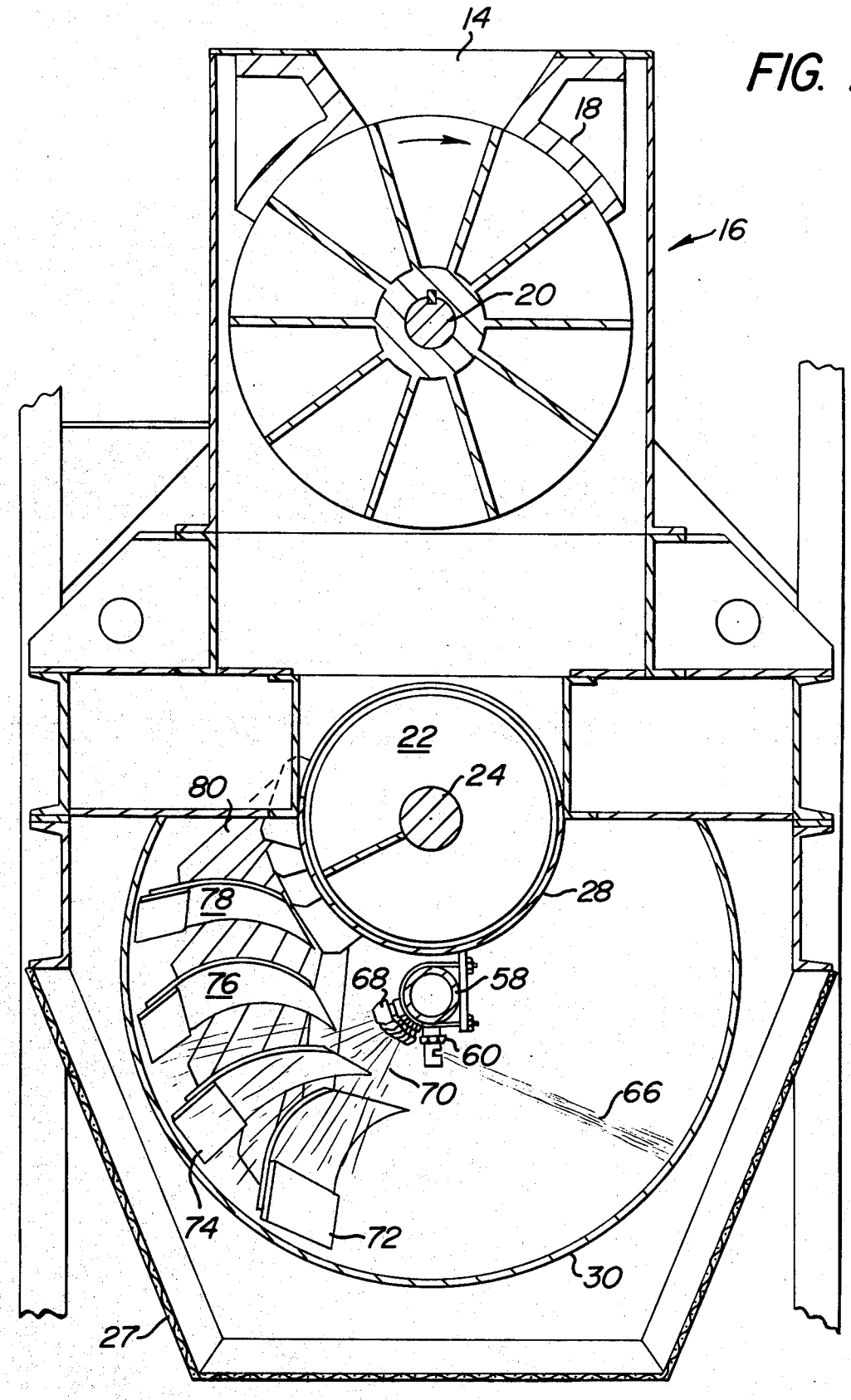
FIG. 2 is a sectional view taken along the line 2—2 in FIG. 1.

A plurality of discrete mixing blades 72, 74, 76 and 78 are provided generally opposite nozzles 68. The blades 72–78 are helically arranged with respect to the axis of drum 30 as shown in FIGS. 2 and 3 with a partial overlap as shown in FIG. 1. Each of the blades 72–78 is curved so as to cause fluidized particles and other particles to move radially inwardly from the ID of drum 30 into the spray 70. Each of the blades 72–78 is supported from the stationary support 28 by means of at least one bracket 80 at an angle relative to a radius of drum 30. Each blade has an adjustable, replaceable, flat wear strip 82 on a planar portion spaced from the ID of drum 30 by a suitable distance such as 0.375 inches. The wear strips 82 are preferably made from a high tensile steel. The upstream end of each blade is closer than its downstream end to a vertical plane containing the axis of drum 30. See FIGS. 2 and 3.

Particles such as fly ash have a density as low as 15 to 18 pounds per cubic foot. The apparatus of the present invention is designed to mix such fly ash with water to raise its density to a preferred range of about 30 to 50 pounds per cubic foot with the moisture content of the slurry being in the range of about 13 to 18 percent water by weight. Particles which have been so treated may then be transported in compliance with Environment Protection Agency regulations and regulations of local municipalities.

The apparatus 10 is used as follows. Dry particulate material such as fly ash is fed from a storage bin to the screw conveyor 22 by the volumetric feeder 12 at a uniform rate. Due to the speed differential whereby shaft 24 rotates about 10% faster than the shaft 20, the conveyor 22 can move material faster than it can be fed by the feeder 12.

The material is fed slightly uphill by the conveyor 22 and discharged radially outwardly through port 62. As the material falls from port 62, it is wetted by falling through the spray 66. The drum 30 is rotated by motor 40. The wetted material flows due to gravity toward the open end 34 of the drum 30 and discharges through port 37 into a vehicle, container, conveyor or the like.

Fluidized particles and other particles insufficiently wetted by rotation of drum 30 contact the blades 72–78 prior to 180°of rotation of drum 30. The blades 72–78 cause the material in contact therewith to flow radially inwardly of the drum 30 through a curved path so as to direct such material into the spray 70 of the nozzles 68. As the wetted material travels toward the open end 34, it is constantly agitated by the combined action of the rotating drum 36 and contact with the blades 72–78. Due to the inclination of the axis of rotation of the drum 30, unloading of the drum 30 is accomplished by gravity whereby no separate unloader is required and mixing is continuous.

The apparatus 10 will continuously mix particulate material and wet the same so long as feeder 12 is operative and/or inlet 14 communicates with the storage bin. In a preferred embodiment, there will be provided a selectively operable valve between inlet 14 and the outlet of the storage bin to provide for control of flow of particulate material to the mixer. If desired, a funnel, a valve, or chute may be connected to the flange to the outlet port 37.

The rate of feed by feeder 12 and the speed of rotation of drum 30 are each independently variable. In addition to changing the speed of motors 40 and 44, further control can be attained by changing the drive sprockets of said motors and/or the volume of water discharged by the nozzles. Since wear on the blade strips 82 will be non-uniform, only the blade strips having excess wear need be replaced. If a long single blade is used, the entire blade would have to be replaced.

The present invention may be embodied in other specific forms without departing from the spirit or essential attributes thereof and, accordingly, reference should be made to the appended claims, rather than to the foregoing specifications as indicating the scope of the invention.

I claim:

1. Apparatus for continuously mixing and unloading of particulate material and water comprising a conveyor, a support for said conveyor, a drum circumscribing said support and conveyor, said drum having an outlet providing communication between the conveyor and the interior of said drum, means for rotating said drum to cause material to flow from the conveyor to said drum outlet, a plurality of discrete blades in said drum adjacent to but spaced from said drum ID, means for supporting said blades so as to be stationary with respect to said drum, a water conduit in said drum, a plurality of nozzles on said conduit radially inwardly of and adjacent said blades, said blades being curved so as to direct material radially inwardly from the drum ID to a spray from said nozzles, and said blades being arranged along a helical path with the outer peripheral edge of said blades being adjacent to but spaced from the ID of said drum.

2. Apparatus in accordance with claim 1 wherein said nozzles discharge a spray to one side of a vertical plane containing the axis of said drum, a second set of nozzles for discharging a spray to an opposite side of said plane within said drum at a location so that the material entering said drum from said conveyor passes therethrough, and said nozzles being located longitudinally along said conduit with said first mentioned nozzles being closer to the outlet of said drum.

3. Apparatus in accordance with claim 1 wherein said means providing communication between said conveyor and said drum interior is an opening in said support, said opening being elongated in a direction parallel to the axis of said drum and located adjacent the axis of said drum.

4. Apparatus in accordance with claim 1 wherein said conveyor is a screw conveyor, said support being a cylindrical tube closed at one end, the closed end of said tube rotatably supporting one end of the shaft of said screw conveyor, said means providing communication between said conveyor and said drum interior being an opening in said tube adjacent said closed end of said tube.

5. Apparatus in accordance with claim 1 including a frame having support brackets, said drum and conveyor being mounted on said frame, a motor on one end of said frame for rotating said drum, another motor on an opposite end of said frame for driving said conveyor, said frame at said opposite end having a feeder, said last mentioned motor being coupled to said feeder for operating said feeder at a speed whereby the feed rate is less than the feed rate of said conveyor.

6. Apparatus in accordance with claim 1 wherein the outer peripheral edge of said blades is at an angle with respect to the longitudial axis of said drum.

7. Apparatus in accordance with claim 6 including a replaceable wear strip at the outer peripheral end of said blades.

8. Apparatus in accordance with claim 1 wherein said nozzles are arranged along said helical path.

9. Apparatus for continuously mixing and unloading particulate material and water comprising a frame, said frame having an inlet at one end, a feeder at said one of said frame, a screw conveyor for receiving material from said feeder, a tube surrounding said screw conveyor, said tube rotatably supporting the end of said screw conveyor remote from said feeder, a drum closed at one end and circumscribing said tube, means on said frame for supporting said drum for rotation about its longitudinal axis which is disposed at an inclined angle with respect to the horizontal and for rotating said drum about said axis, means defining an opening providing communication between said tube and the interior of said drum at a location adjacent the closed end of said tube, means beneath the elevation of said opening for directing a spray against the ID of said drum so that material discharged through said opening passes through said spray, a plurality of discrete stationary blades in said drum and supported by said tube, said blades being helically arranged around an arcuate portion of said tube on a lower quadrant of said tube, at least one nozzle adjacent each blade, each blade being curved so as to direct material in a generally radially inwardly direction from the ID of said drum into a spray from said last mentioned nozzles.

10. Apparatus in accordance with claim 9 wherein said blades partially overlap and have removable wear plates at their outer periphery.

11. A method of continuously mixing and unloading fine particulate material subject to being fluidized such as fly ash comprising the steps of:

a. conveying the fine particles and introducing them into a rotating drum adjacent a closed end of the drum, b. passing the particles through a water spray as they discharge from the conveyor into the interior of said drum, c. moving particles and water in a direction from said closed end of said drum to an outlet for discharge from said drum, contacting at least some of said particles with spaced helically arranged stationary blades as the particles move toward said outlet of said drum, d. causing particles to move generally radially inwardly from the ID of said drum into a second water spray by contact-with curved portions of said blades, and e. rotating said drum in a direction whereby the particles wetted by passing through the first mentioned spray are moved circumferentially by said rotation of the drum toward said blades before such wetted particles have traveled through 180° of rotation of the drum.

* * * * *